US005155755A

United States Patent [19]

Penato et al.

[11] Patent Number: 5,155,755

[45] Date of Patent: Oct. 13, 1992

[54] ANODE FOR X-RAY TUBES WITH COMPOSITE BODY

[75] Inventors: Jean-Marie Penato, Les Essarts-le-Roi; Michel Laurent, Plaisir; Philippe Thomas, Villeneuve sous Dammartin, all of France

[73] Assignee: General Electric CGR S.A., Issy les Moulineaux, France

[21] Appl. No.: 619,923

[22] Filed: Nov. 27, 1990

[30] Foreign Application Priority Data

Nov. 28, 1989 [FR] France ..... 89 15634

[51] Int. Cl.[5] ..... H01J 35/08

[52] U.S. Cl. ..... 378/143; 378/144

[58] Field of Search ..... 378/143, 144, 125, 127, 378/142, 128

[56] References Cited

U.S. PATENT DOCUMENTS

| | | | |
|---|---|---|---|
| 4,298,816 | 11/1981 | Hirsch et al. | 378/144 |
| 4,461,020 | 7/1984 | Hubner et al. | 378/143 |
| 4,472,827 | 9/1984 | Gabbay et al. | 378/147 |
| 4,571,286 | 2/1986 | Penato | 205/118 |
| 4,670,895 | 6/1987 | Penato et al. | 378/125 |
| 4,799,250 | 1/1989 | Penato et al. | 378/144 |
| 4,891,831 | 1/1990 | Tanaka et al. | 378/144 |
| 4,958,364 | 9/1990 | Guerin et al. | 378/144 |
| 4,964,147 | 10/1990 | Laurent et al. | 378/144 |
| 5,008,918 | 4/1991 | Lee et al. | 378/143 |

FOREIGN PATENT DOCUMENTS

| | | | |
|---|---|---|---|
| 0031940 | 7/1981 | European Pat. Off. . | |
| 0062380 | 10/1982 | European Pat. Off. . | |
| 0196542 | 11/1984 | Japan | 378/143 |
| 0095841 | 5/1985 | Japan | 378/143 |
| 0271333 | 11/1987 | Japan | 378/143 |

*Primary Examiner*—Janice A. Howell
*Assistant Examiner*—Don Wong
*Attorney, Agent, or Firm*—Cushman, Darby & Cushman

[57] ABSTRACT

The disclosure pertains to X-ray tubes and, more particularly, in these tubes, it pertains to rotating anodes. The disclosed anode for an X-ray tube has a body or substrate on which a target is formed by a layer of target material, wherein the body comprises at least two parts formed by a first material, these two parts being connected to each other by a layer of a second material having greater plasticity than that of the first material.

8 Claims, 1 Drawing Sheet

ANODE FOR X-RAY TUBES WITH COMPOSITE BODY

BACKGROUND OF THE INVENTION

1. Field of the Invention

The invention concerns an X-ray tube anode, more particularly a rotating anode of the type having a composite main body base that bears a target formed by a surface layer of an X-ray emitting material.

2. Description of the Prior Art

In X-ray tubes, notably those used for X-ray diagnosis, the X-radiation is obtained under the effect of an electron bombardment of a layer of a target material, i.e. generally a material, with a high atomic number, that is refractory and is a good conductor of heat such as, for example, tungsten, molybdenum or an alloy containing at least one of these elements. These are the most commonly used elements, but the invention is not restricted to an anode with an emissive material containing these elements or their alloys.

The target layer is bombarded on a small surface, called a focal spot, forming the source of the radiation.

For a long time now, the high instantaneous power values (of the order of 100 KW) used and the small dimensions of the focal spot have led to the use of rotating anodes in order to distribute the heat flux on a greater area than that of the focal spot and to dissipate it more efficiently.

This distribution and dissipation of heat is all the more efficient as the linear speed of rotation of the anode is high.

However, this linear speed is limited by the mechanical strength of the anode and, notably, the risks of its breaking up due to the formation of cracks, notably in the material forming the target layer, which spread into the other materials forming the anode.

In fact, rotating anodes are generally formed by a body or substrate forming a block with a regular shape such as the shape of a disk, a cone or similar shape, on which one or more layers of an X-ray emitting material or target material are deposited. Generally, the adhesion of the layer of target material to the body is improved by the deposition of an intermediate anchoring layer, thus creating a certain continuity between the emitting material and the material forming the substrate, for example by surface diffusion of the anchoring material into the other two materials or vice versa. This continuity may favor the spread of the cracks generated in the emitting material.

The invention is designed notably to overcome these drawbacks by proposing an anode comprising a body of a particular structure that restricts the cracks in the body and thus reduces the risk that the anode will break up.

SUMMARY OF THE INVENTION

To this effect, the invention proposes an anode for an X-ray tube, said anode having a body or substrate on which a target is formed by a layer of X-ray emitting target material. The body comprises at least two parts formed by a first material, these two parts being connected to each other by a layer of a second material having greater plasticity than that of the first material.

By plasticity of a material is meant the ability of the material to get deformed (i.e. to change shape) permanently.

Thus, for example, a material having high ductility displays high plasticity.

The Applicant has discovered that the presence of an interface between materials with different degrees of plasticity restricts and even stops the spread of the cracks.

Thus, in a preferred embodiment of the invention, the body is formed by two parts made of a first brittle material and joined to each other by a layer of brazing material. The brazing material used is a material with plasticity, such as a metal or metal alloy.

According to another feature, the layer between the parts made with the first material is parallel to the longitudinal plane of the body, i.e., perpendicular to the plane of the cross-sectional view in FIG. 1.

According to another feature, the parts made of first brittle materials form layers parallel to the longitudinal plane of the body thus forming a multiple-layer structure.

The first material should be refractory and should have sufficient mechanical strength to form an X-ray tube anode and, notably, a rotating anode.

As examples of suitable materials, carbon, graphite, ceramics or carbon-carbon composite materials may be used.

As for the nature of the second material, this material should have a degree of plasticity that is sufficient to absorb or to dampen the stresses created during the generation of cracks at the interface with the first material.

Of course, this material should display such plasticity at all the temperatures of operation of the tube.

These temperatures of operation are generally between ambient temperature and 1400° C.

The materials suitable for making the plastic layer are notably platinum, zirconium, metal alloys such as titanium-zironium-beryllium alloy or similar materials. This list is given purely by way of indication and is not restrictive.

Besides, the thickness of these plastic layers is not of critical importance. However, in a preferred embodiment of the invention, this thickness is smaller than that of the layers made of non-plastic material: for example, it is in the range of one-hundredth of a millimeter to a few tenths of a millimeter.

Another object of the invention is an X-ray tube including a rotating anode such as is described here above.

BRIEF DESCRIPTION OF THE DRAWINGS

Other aims, advantages and features of the invention will appear more clearly in the light of the following detailed description of embodiments of the invention, these embodiments being given by way of examples and the description being made with reference to the appended figures, of which.

DESCRIPTION OF PREFERRED EMBODIMENTS

Figure 3:
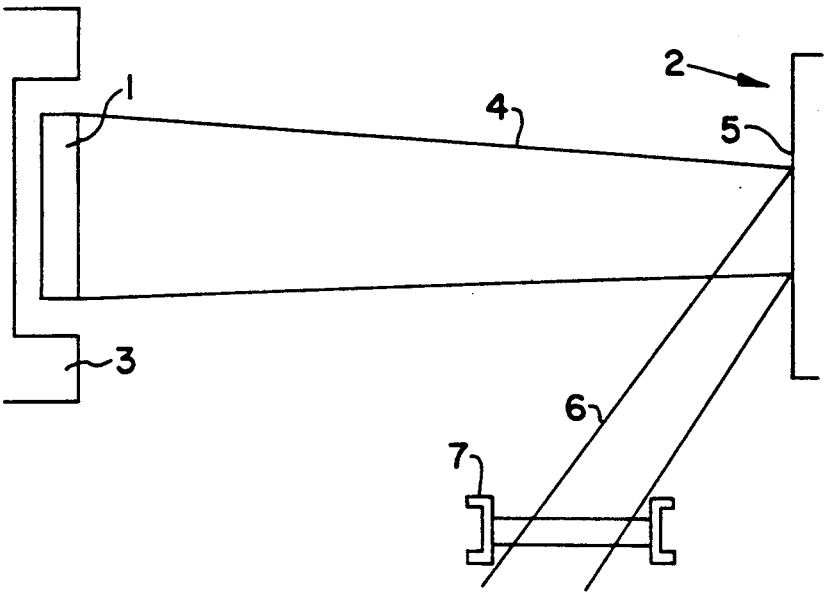
FIG. 3 is a schematic view illustrating the principle of an X-ray tube.

Referring to FIG. 3, an X-ray tube comprises, in an empty chamber (not shown), a cathode 1 located so as to face an anode 2. The cathode 1 is inserted in an focusing piece 3 enabling the electron beam 4 emitted by the cathode to be guided towards and focused on a small surface 5 of the anode 2 called a focal spot.

The emission of the electron beam 4 by the cathode is generated by the heating of a filament (not shown) to a high temperature.

The anode 2 receives the electron beam 4, and emits an X-ray beam referenced 6, notably towards a window of use 7 provided, for example, on the envelope tube.

The anode 2 is mounted on a rotationally driven shaft (not shown). Thus, the focal spot 5 is a ring of small width defined on the surface of the anode 2.

Figure 1:
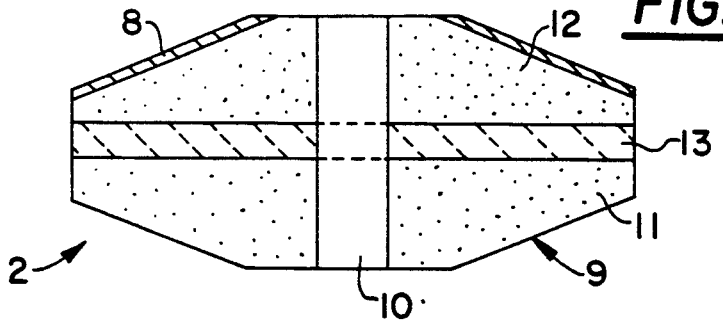
FIG. 1 is a schematic cross-sectional view of a first embodiment of the invention.
Figure 2:
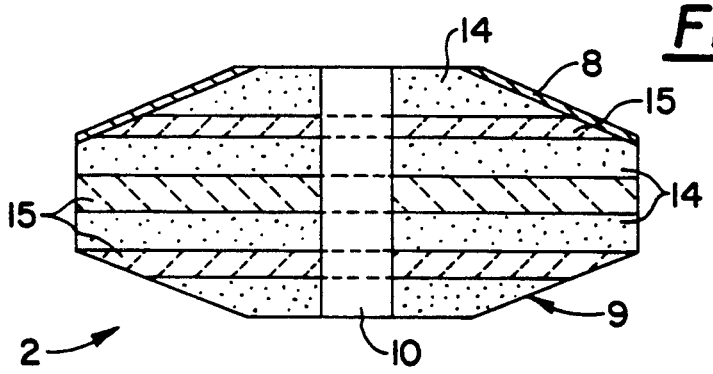
FIG. 2 is a schematic cross-sectional view of a second embodiment of the invention.

Referring to FIGS. 1 and 2, we shall now describe two embodiments of the invention.

In a first embodiment shown in FIG. 1, the anode 2 comprises a body 9 with inclined faces on which a target layer 8 is deposited. The body 9 or substrate has a bore hole 10 at its center. This bore hole goes right through and enables the anode 2 to be fixed to a shaft (not shown).

The body 9 consists of two parts 11, 12 made of a brittle material such as graphite, joined together by a layer 13 of material with plasticity, advantageously a brazing material such as a titanium-zirconium-beryllium alloy. This brazing can also be done with zirconium or platinum.

This layer of plastic material has a thickness of about 0.2 millimeter.

In the second embodiment, shown in FIG. 2, the anode 2 is formed by washers 14 made of a brittle material such as graphite, joined together by layers 15 made of plastic material such as the materials already mentioned heretofore.

Thus, this kind of a structure enables the use, as a material forming the body, of a light material such as graphite or a carbon-carbon compound while, at the same time, restricting the brittleness and the risks of its breaking up by stopping the spread of cracks at the interfaces between the plastic material layers 13 or 15 and the brittle material 11, 12 or 14.

What is claimed is:

1. An anode for an X-ray tube comprising:

a body or substrate on which a target is formed by a layer of target material, said body comprising:

at least two structures of a first material, and at least one layer of a brazing material having greater plasticity than the first material, each layer being located between and bonding two structures so that no two structures or layers are adjacent.

2. An anode according to claim 1, wherein the structures of the first material and the layers of the brazing material are substantially parallel.

3. An anode according to claim 1, wherein the thickness of each of the layers of the brazing material is less than the thickness of each of the structures of the first material.

4. An anode according to claim 3, wherein the thickness of each of the layers of the brazing material is within the range of 100th of a millimeter to a few tenths of a millimeter.

5. An anode according to claim 1, wherein the first material is chosen from a group including graphite, ceramics and carbon-carbon composites.

6. An anode according to claim 1, wherein the brazing material is an alloy or a metal alloy.

7. An anode according to claim 1, wherein the brazing material is chosen from the group including zirconium, platinum and metal alloys such as titanium-zirconium-beryllium alloy.

8. An X-ray tube comprising:

an anode having a body or substrate on which a target is formed by a layer of target material, said body comprising:

at least two structures of a first material, and at least one layer of a brazing material having greater plasticity than the first material, each layer being located between and bonding two structures so that no two structures or layers are adjacent.

* * * * *